United States Patent [19]

Douglas

[11] Patent Number: 4,722,105

[45] Date of Patent: Feb. 2, 1988

[54] FLUID SUPPORT SYSTEMS

[76] Inventor: Owen Douglas, 7905 90th Ave. SW., Tacoma, Wash. 98498

[21] Appl. No.: 902,972

[22] Filed: Sep. 2, 1986

[51] Int. Cl.[4] ..... A47C 27/10; A61G 7/00

[52] U.S. Cl. ..... 5/453; 5/469

[58] Field of Search ..... 5/453–456, 5/449, 469, 423

[56] References Cited

U.S. PATENT DOCUMENTS

| | | | |
|---|---|---|---|
| 3,822,425 | 7/1974 | Scales | 5/456 |
| 4,279,044 | 7/1981 | Douglas | 5/453 |
| 4,525,885 | 7/1985 | Hunt et al. | 5/453 |
| 4,638,519 | 1/1987 | Hess | 5/455 |

FOREIGN PATENT DOCUMENTS

| | | | |
|---|---|---|---|
| 1545806 | 5/1979 | United Kingdom | 5/455 |
| 2141333 | 12/1984 | United Kingdom | 5/455 |

*Primary Examiner*—Alexander Grosz

[57] ABSTRACT

An air support system suitable as a hospital bed comprises a plurality of contiguous, inflatable cells 2. A blower 25 supplies inflation air to the cells. The blower 25 is driven by an electric motor 26 and solenoid valves 29, 50 operate automatically, in the event of electrical power failure, to seal-off inflation air present in the cells. Three-position spool valves 72–74 each operate to direct the flow of cell inflation air through a selected one of three alternative paths.

13 Claims, 16 Drawing Figures

FIG. 1.
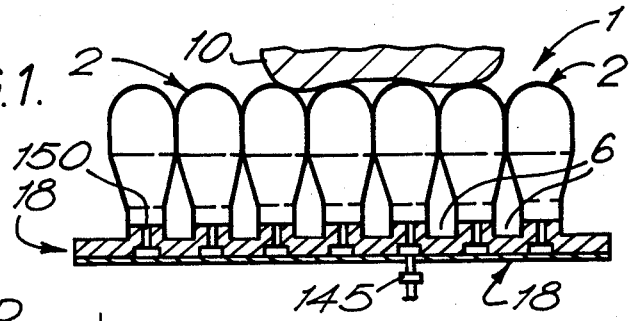
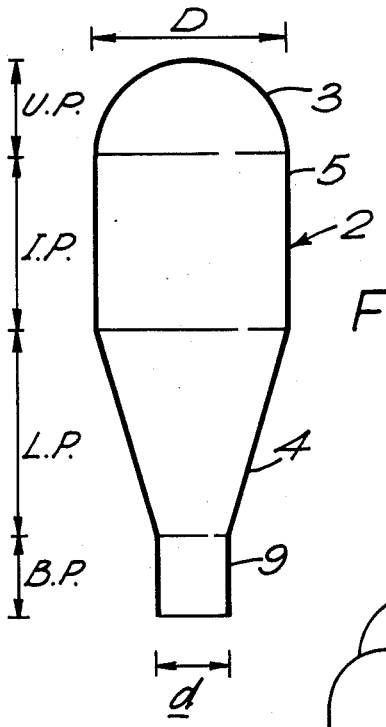
FIG. 2.
FIG. 3.
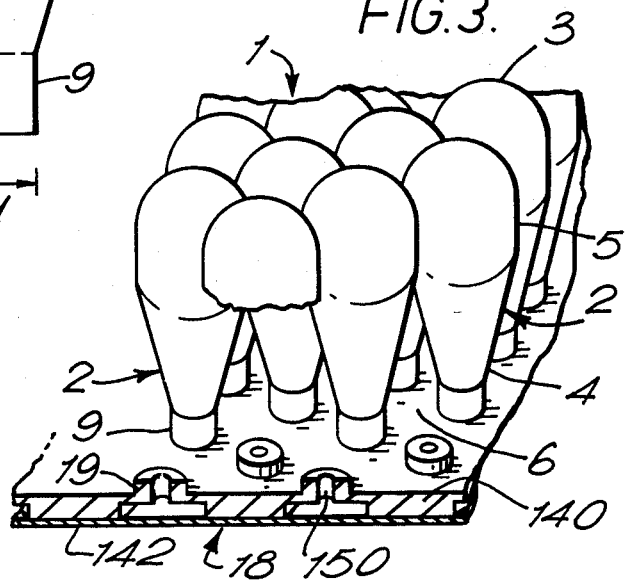

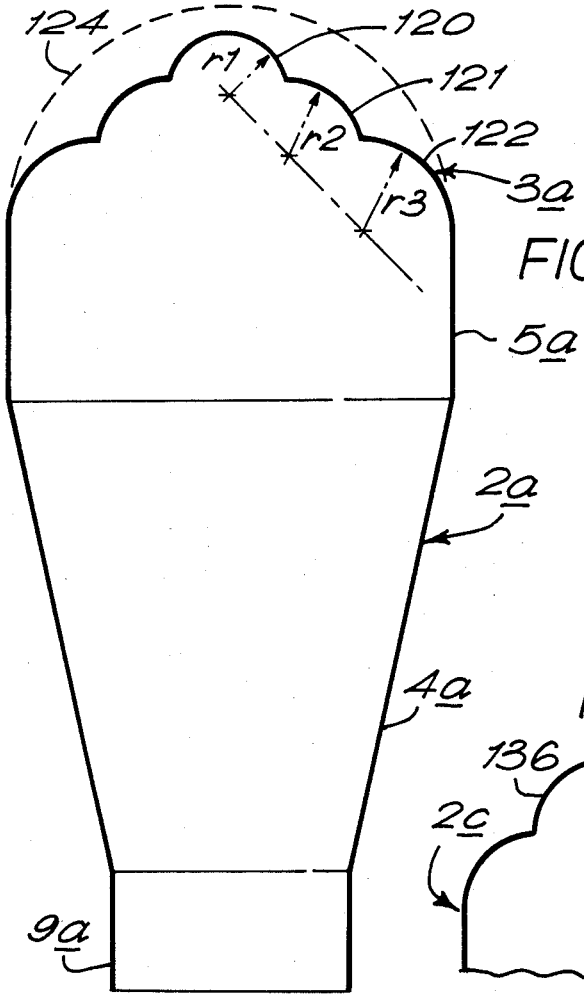
FIG.9.
FIG.11.
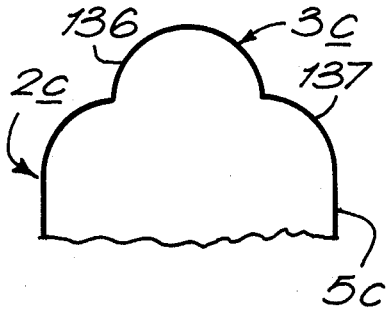
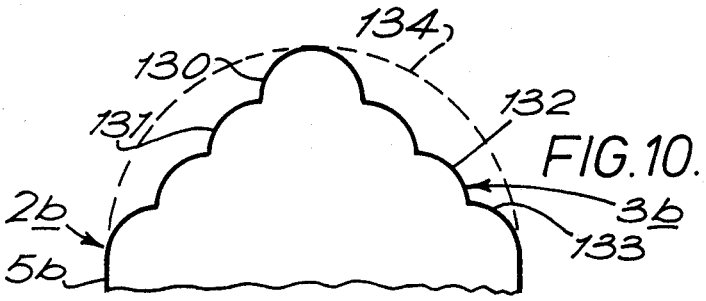
FIG.10.

FLUID SUPPORT SYSTEMS

BACKGROUND TO THE INVENTION

This invention relates to fluid support systems and is concerned with, (but is not to be considered as being restricted to), fluid support systems for supporting, at least in part, the bodies of persons confined to bed.

When a person is confined to bed, soft tissue is compressed between the skeleton and the supporting surface. Care is usually taken to provide a deformable mattress but, nevertheless, high local pressures occurring in the deformed tissue will compress blood vessels and tissue damage may result. A patient resting on a normal hospital bed will experience local pressures of the order of 150 mm Hg (2.9 psi). The blood pressure through the capillary vessels of the skin and underlying tissue is generally accepted as being 26 mm Hg (0.503 psi), but this figure may be considerably reduced for an ill patient. When contact pressures exceed this value, blood flow is stopped, resulting in transient damage and, finally, deep penetrating necrosis of tissue, muscle and bone. Skin may also be damaged by shear stresses resulting from friction between the skin and the supporting structure. Such stresses are a function of the local pressure and the area of contact.

At least some of the aspects of the present invention can be viewed as improvements in the fluid support system disclosed by my U.S. Pat. No. 4,279,044.

SUMMARIES OF THE INVENTION

According to one aspect of the present invention, a fluid support system comprises a plurality of inflatable cells, blower means for supplying pressurised inflation fluid to the cells, electrically-powered drive means for driving the blower means, connectable to a source of electrical power, and valve means operable automatically, in the event of failure of the supply of electrical power, to seal off inflation fluid present in the cells.

The valve means may comprise solenoid-operated valve means biased towards a closed position but held open by electrical energisation.

In addition, the system may comprise three-position valve means operable to direct fluid flow through three alternative paths.

Preferably, the three-position valve means comprise spool valve means.

According to yet another aspect of the present invention, a fluid support system comprises a plurality of inflatable cells having upper portions, lower portions and intermediate portions, the intermediate portions being contiguous when the cells are inflated, and the lower portions then defining spaces therebetween, and means for supplying heat transfer fluid to said spaces, so as to remove heat from or supply heat to the cells.

According to a further aspect of the present invention, at least part of a fluid support system comprises a plenum chamber, a plurality of inflatable cells having their interiors connected to the plenum chamber, the cells having portions which are contiguous when the cells are inflated, and means for supplying pressurised fluid to the plenum chamber, whereby the cells are inflated, the internal volume of the plenum chamber being substantially less than the total internal volume of the cells connected thereto.

A fluid support system may comprise a series of such plenum chamber and cells combinations.

The combinations are preferably movable relative to each other in an articulated manner.

Means may be provided whereby the cells of one combination may be inflated to a pressure differing from the cells of another combination.

The invention also comprises any novel feature or combination of novel features disclosed herein.

BRIEF DESCRIPTION OF THE DRAWINGS

An embodiment of the invention according to its various aspects will now be described by way of example only with reference to the accompanying drawings, wherein:

FIG. 1 is a side view, in section, of a fluid support system,

FIG. 2 is a side view, to an enlarged scale, of the form of inflatable cell used by the system, FIG. 3 is a cross-sectional view, in perspective, of part of the system, FIGS. 9, 10 and 11 are side views of modified inflatable cell.

In the figures, like reference numerals refer to like components and features.

DETAILED DESCRIPTION OF THE PREFERRED EMBODIMENTS

Figure 4:
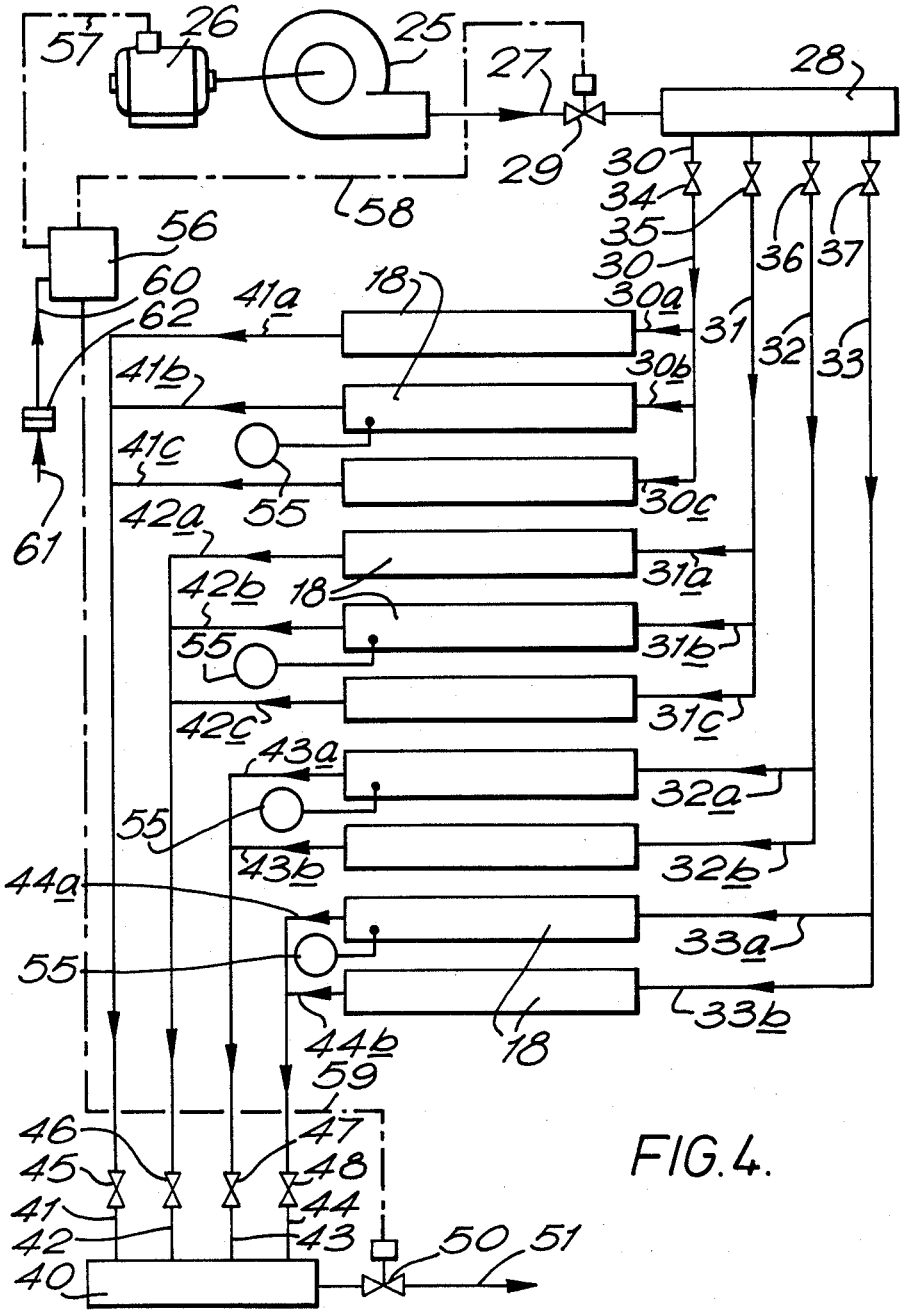
FIGS. 4 and 5 illustrate alternative cell inflation control and distribution arrangements.

With reference first to FIGS. 1, 2 and 3, a fluid support system 1 for supporting the body 10 of a person confined to hospital, and serving as a hospital bed, comprises a plurality of inflatable cells 2, each having an upper portion 3, a lower portion 4, an intermediate portion 5, and a bottom portion 9. The intermediate portions 5 of the cells 2 are contiguous when the cells are inflated, and the lower portions 4 then define spaces 6 therebetween. The upper portions 3 of the cells 2 form body support surfaces. The cells 2 are divided into a plurality of groups, each group defining a body support surface.

An inflatable cell 2 is of thin, (about 0.010″) flexible material, preferable neoprene. With reference to FIG. 2, the upper portion 3 of a cell 2 is substantially hemispherical; the intermediate portion 5 of the cell is substantially cylindrical; each cell lower portion 4 tapers downwardly, and each cell bottom portion 9 is substantially cylindrical.

Approximate dimensions of a cell 2 are as follows:

D=3.0″

I.P.=4.0″ d=1.0″

L.P.=4.0"
U.P.=1.5"
B.P.=1.0"

The cells 2 of each group are demountably attached to a plenum chamber 18 of relatively small volume, (compared with the total internal volume of the cells 2 attached to the chamber 18). The cells 2 are attached to the plenum chamber 18 by way of upwardly-projecting spigots 19 which receive bottom portions 9 of the cells 2 and are releasably secured thereto.

The spigots 19 have central passageways 150 of small bore formed therein which allow pressurised air to pass from the plenum chamber 18 into the interiors of the cells 2 attached thereto, so as to inflate them.

Cell Inflation Air Control and Distribution

FIG. 4 shows how the plenum chambers 18 are supplied with cell inflation air.

The outlet of an air blower 25 driven by an electric motor 26 discharges into a duct 27 leading to an inlet manifold 28. A solenoid valve 29 is fitted in the duct 27. The valve 29 is biased towards the closed position and is open only when energised.

The inlet manifold 28 is connected to ten plenum chambers 18 by way of ducts 30, 31, 32, 33. Lockable metering or throttling air-flow control valves 34, 35, 36, 37 are fitted in the ducts 30–33. Ducts 30 and 31 each supply pressurised air to three plenum chambers 18, by way of branch lines 30*a*, 30*b*, 30*c* and 31*a*, 31*b*, 31*c* respectively. Ducts 32 and 33 each supply pressurised air to two plenum chambers 18, by way of branch lines 32*a*, 32*b* and 33*a*, 33*b* respectively.

An outlet manifold 40 collects air leaving the plenum chambers by way of ducts 41, 42, 43, 44. Ducts 41, 42 have branch lines 41*a*, 41*b*, 41*c* and 42, 42*b*, 42*c* respectively. Ducts 43, 44 have branch lines 43*a*, 43*b* and 44*a*, 44*b* respectively. Adjustable air flow control valves 45, 46, 47 and 48 are fitted in the ducts 41–44. A solenoid valve 50 is fitted in a duct 51 connecting the outlet manifold 40 with atmosphere. Like the solenoid valve 29, the valve 50 is biased towards the closed position and is open only when energised.

The plenum chambers 18 are divided into four groups, each group being provided with an inflation air pressure gauge 55.

The supply of electrical energy to the electric motor 26 is regulated by a controller 56 by way of an electrical signal line 57. The controller 56 is also connected to the solenoid valves 29, 50 by way of electrical signal lines 58, 59. Electrical power is supplied to the controller 56 (and thus to the motor 26 and electrically-controlled valves 29, 50), by way of a line 60. The line 60 is demountably connected to a source 61 of electrical power by way of a connection 62.

In operation, the controller 56 is used to energise the solenoids of the valves 29, 50, by way of the signal lines 58, 59, so that the valves are held open. The motor 26 of the blower 25 is switched on at the same time so that the blower is caused to supply pressurised air to the cells 2 (FIG. 1) of the system 1 so as to inflate them. A cell inflation pressure of the order of 7" w.g. (13 mm Hg) is required to support the average person.

Inflation pressure of the cells of each group may be adjusted by use of the valves 45–48, according to the needs and comfort of the person being supported by the cells.

The controller 56 can be operated manually so as to de-energise, i.e. close, the solenoid valve 50, whereupon the plenum air pressures will rise to a maximum, causing the cells 2 to become substantially "harder".

The pressure/flow characteristics of the blower 25 are such that when the flow of air through the plenum chambers 18 is terminated, (by closure of the valve 50), the inflation air pressure is substantially greater than that required to support a patient.

This "hardening" of the cells 2 is desirable in order to:

(a) move or examine a patient on a less-yielding body-support surface,
(b) to assist a patient in getting off or getting on to the support surface, or
(c) to employ cardiac arrest techniques to a patient suffering a heart attack.

As all the components shown in FIG. 4 (with the exception of the power source 61) form part of the system 1 and are movable therewith, the controller 56 can be operated so as to terminate the supply of electrical energy to the motor 26 as well as to the solenoids of the valves 29, 50. The valves 29, 50 then close, so as to automatically seal-off inflation air within the cells 2. The electrical connection 62 can then be broken, and the system 1 moved to another area. Some out-leakage of inflation air is inevitable, but tests made show that the system 1 will continue to support a patient for at least 30 minutes, and, in the case of improved versions of the invention, for about 24 hours.

It will be appreciated that, in the event of failure of the supply of electrical power, including that supplied to the blower 25, the solenoid valves 29, 50 will close automatically, to seal-off the cell inflation air once again, until power is restored.

Because the air supplied by the blower 25 is throttled, (in order to obtain a pressure drop), the flow through the system is small and air leakage insignificant.

Figure 5:
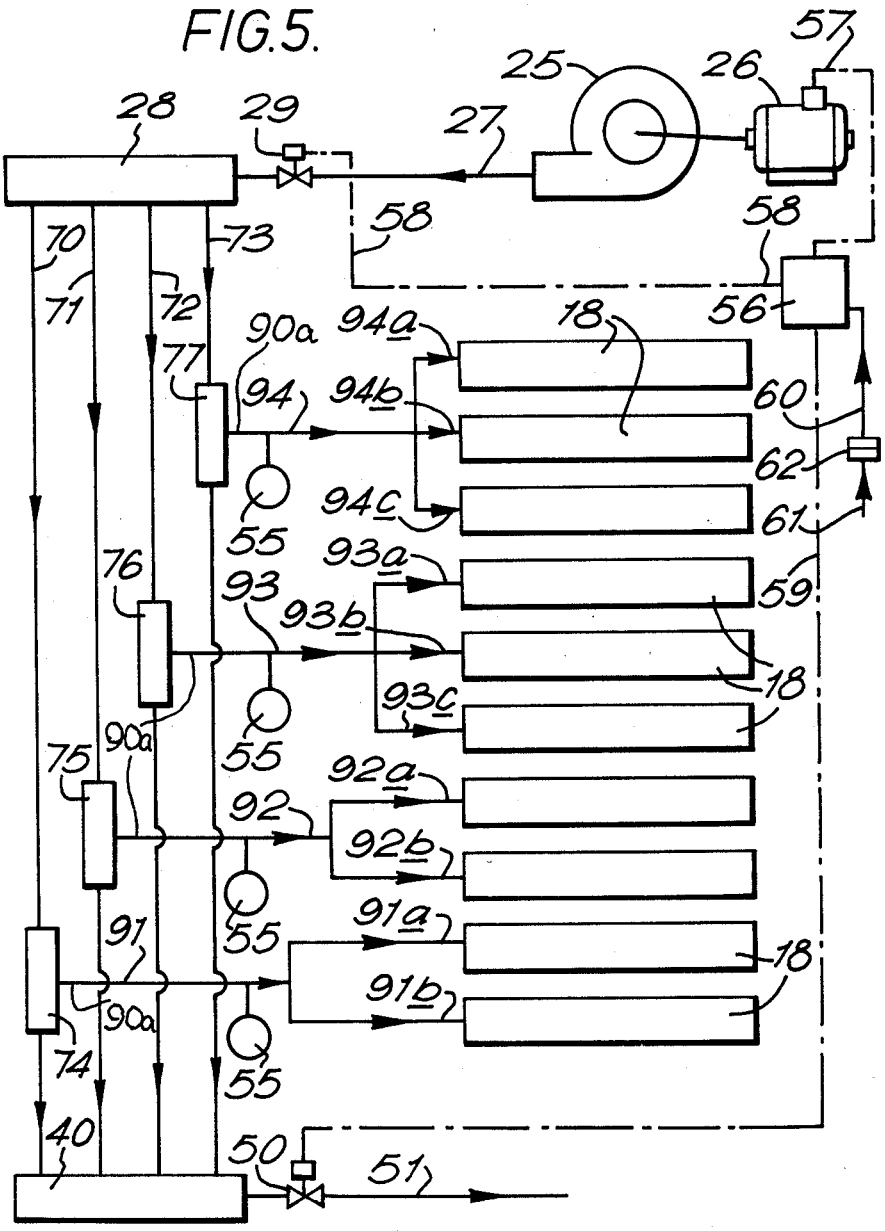

FIG. 5 illustrates a modified cell inflation supply and control arrangement. Many of the components shown in FIG. 5 are common to many shown in FIG. 4. However, there are differences, namely:

The inlet and outlet manifolds 28, 40 are connected by main air ducts 70, 71, 72, 73 with spool valves 74, 75, 76, 77 fitted in those ducts. With additional reference to FIG. 6, the valve 74, (valves 74–77 are identical), comprises a body 80 with oppositely-facing valve seats 81, 82 disposed on a common axis 83.

A valve spindle 84 is disposed axially on the axis 83 and carries a pair of spool valves 85, 86 which cooperate with the valve seats 81, 82. The valve 74 has a connection 70*a* coupled to the inlet side of the duct 70 and a connection 70*b* coupled to the outlet side thereof. The valve 74 also has a central connection 90*a* coupled to a duct 91 having branch lines 91*a*, 91*b*, coupled in turn to a group of two plenum chambers 18. With reference once more to FIG. 5, the valves 74, 75, 76, 77 are coupled to branch ducts 91, 92, 93, 94 with branch lines 91*a*, 91*b*, 92*a*, 92*b* etc.

Figure 6:
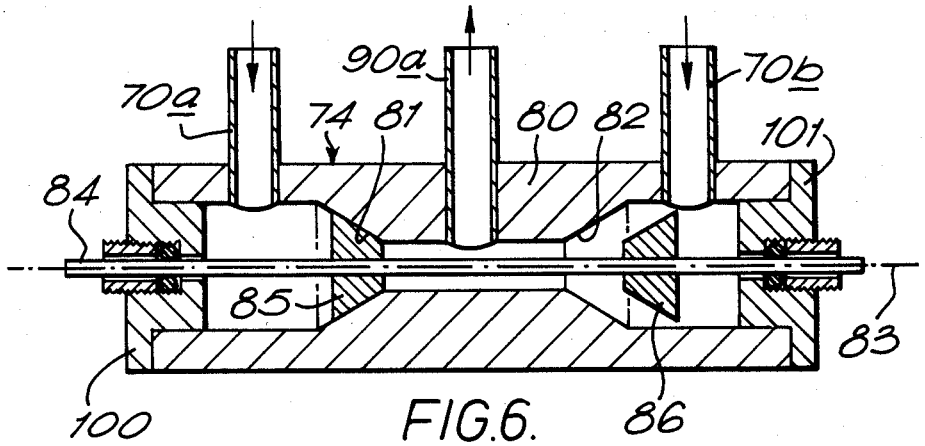
FIG. 6 is a side view, in section, of a control valve used in the arrangement of FIG. 5.

The valve spindle 84 is sealed to the valve body 80 by glands 100, 101. The valve spindle is positionable axially in three alternative positions, two extreme, and one intermediate. In one extreme position, namely as shown in FIG. 6, the spool valve 85 cooperates with the valve seat 81 whereby passage of air between connections 70*a* and 90*a* is prevented but air drainage flow can take place between connections 90*a* and 70*b*. In the other extreme position, the spool valve 86 cooperates with the valve seat 82 whereby passage of air between connections 70*b* and 90*a* is prevented but air flow can take place between connections 70*a* and 90*a*. In the intermediate position, air can flow between connections 70*a* and 90*a*, and also between 90*a* and 70*b*. Thus the third alternative flow path comprises a combination of the other two flow paths.

Thus the spool valve 74 is operable to direct the flow of cell inflation air through a selected one of two alternative paths, or to assume an intermediate position whereby air flows through both paths.

Figure 7:
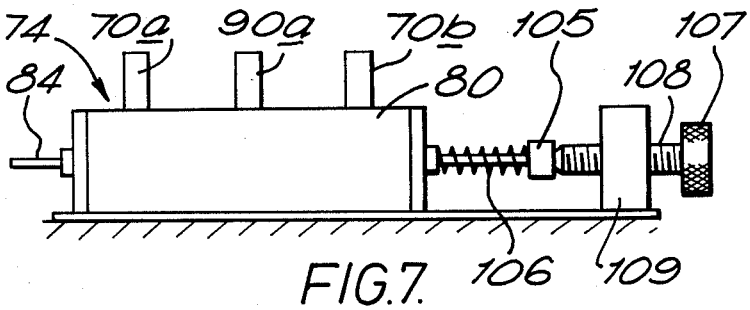
FIG. 7 is a side view of the control valve and one form of actuating means that may be associated therewith.

FIG. 7 shows how the spool valves 85, 86 (of FIG. 6) may be moved from one position to another in order to achieve the desired diversion of air flow whereby cell inflation is adjustable. A headstop 105 is fitted to one end of the spindle 84 and a compression spring 106 disposed between the headstop 105 and the valve body 80. The spring 106 urges the spindle 84 into the position illustrated by FIG. 6, i.e. with valve 85 closed and valve 86 open, so that the interiors of the associated plenum chambers 18 (FIG. 4) are exhausted to atmosphere.

A control knob 107 is fitted to the end of a screw-threaded rod 108 located by a cooperating hole in a support 109. By screwing up the rod 108 the valve spindle 84 is displaced sufficiently to change over the relative positions of the spool valves 85, 86. In practice, axial displacement of the spindle 84 is small, say 0.0625 inches. The knob 107 is used to set or "tune" the valve 74 to an intermediate position so that pressure in the associated plenum chamber 18 is at the desired level.

Figure 8:
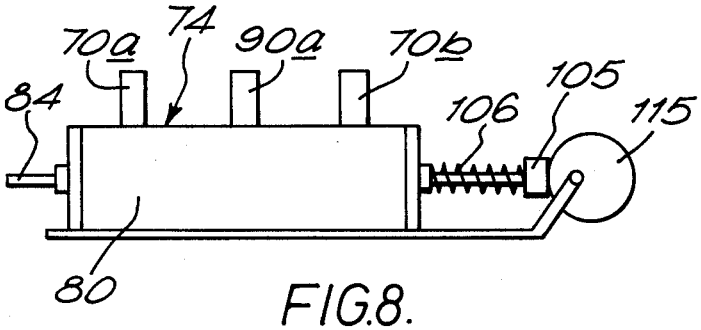
FIG. 8 is a side view of the control valve and an alternative form of actuating means.

FIG. 8 illustrates alternative valve actuating means. In this arrangement, the headstop 105, and hence the spindle 84, is displaced by rotation of a cam 115.

With reference once more to FIG. 6, with the valves 85, 86 in the position shown, the plenum chambers 18 connected to connection 90*a* are de-pressurised. On the other hand, if valve 85 is made to open and valve 86 made to close, then pressure within the plenum chambers 18 will rise to the shut-off, i.e. maximum pressure of the blower 25. (FIG. 5).

As an alternative to the three-position valves 74–77, sleeve valves may be employed, each comprising a valve member slidable in a ported valve body.

The controller 56 (FIG. 5) incorporates a three-position switch, the positions being labelled "Maximum", "Normal" and "Minimum".

"Normal" position.

The system is operating normally at the desired intermediate cell air pressure and supporting a patient. Solenoid valves 29, 50 are open. Pressure control of the groups is by adjustment of the valves 74–77. In the event of electrical power failure the solenoid valves 29, 50 close automatically to seal-off the inflated cells 2.

"Maximum" position.

Solenoid valve 29 is open but solenoid valve 50 de-energised so that it closes. This results in the supply of inflation air at maximum pressure to the body support cells 2, and allows patient examination, patient assistance, patient cardiac arrest techniques or patient transportation as described above with reference to FIG. 4.

"Minimum" position.

The solenoid valve 29 is made to close, thus shutting off the supply of inflation air. Solenoid valve 50 remains open. This switch position is used, in the absence of a patient, to deflate the cells 2 prior to removal of the plenum chambers 18 for service and/or sterilisation. Alternatively, with a patient remaining, to provide a solid "backboard" for cardiac or pulmonary resuscitation.

It will be noted that in the cell inflation air system of FIG. 4, air flows through the plenum chambers 18 en route to atmosphere, whereas in the case of the modified system of FIG. 5, the air flows directly to atmosphere, and the plenum chambers 18 are filled and pressurised in a dead-ended manner.

The system of FIG. 4 has very low air flow requirements. The system of FIG. 5 reduces substantially the time required to achieve a desired pressure change within the cells 2.

In practice, the air flow requirements of the FIG. 4 system are approximately 4 cubic feed per minute and those of the FIG. 5 system approximately 12 cubic feed per minuted. Other commercially available systems have advertised air flows of approximately 60 cubic feet per minute. Compared with systems according to the present invention, such systems have greater bulk, operate with greater noise levels and are more expensive.

The Body Support Cells.

With reference to FIG. 2 once more, although the cell 2 illustrated thereby performs quite well, when a point load is applied, the hemispherical upper portion 3 acts as an arch. Such a case can occur when the cell supports the back portion of a patient's ankle. The pressure then experienced by the patient is amplified considerably.

FIG. 9 illustrates a modified cell 2*a* having an upper portion 3*a* defining a plurality of convexities each of part-spherical form.

The multi-convex portion 3*a* has a central, upper part 120 of hemispherical form superimposed on and bounded by an intermediate part 121 of annular form, which is superimposed on and bounded in turn by a lower part 122, also of annular form. The dotted line 124 indicates the hemispherical shape the parts 120, 121, 122 replace.

The intermediate portion 5*a* has a length approximately the same as the depth of the upper portion 3*a*.

Radii r1, r2, r3 of the parts 120, 121, 122 successively increase.

FIG. 10 illustrates a modified cell 2*b*. If FIG. 9 can be said to illustrate a cell with a "three-stage" upper portion 3*a*, FIG. 10 can be said to illustrate a cell with a four-stage upper portion 3*b*.

The cell 2*b* of FIG. 10 has an upper portion 3*b* defining an upper, central part 130, of hemispherical form, superimposed on and bounded by a first intermediate part 131, superimposed on and bounded in turn by a second intermediate part 132, which is then superimposed on and bounded by a lower part 133. The part-spherical parts 130–133 are of substantially equal radii. Parts 131–133 are of annular form.

FIG. 11 illustrates a "two-stage" cell 2*c* wherein an upper, central part 136 of hemispherical form is superimposed on and bounded by a lower part 137 of annular form.

Plenum Chamers 18.

Figure 12:
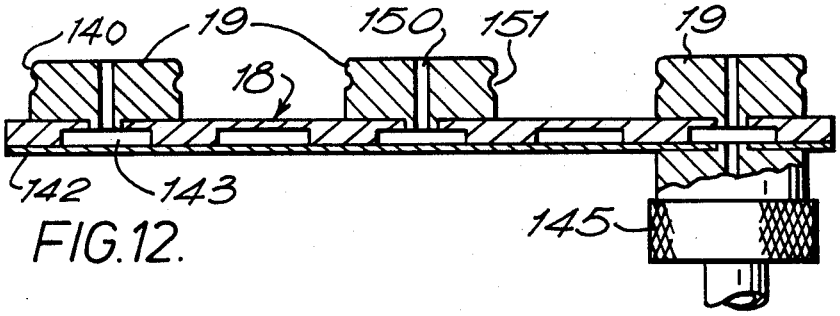
FIG. 12 is a side view, in section, of a preferred form of plenum chamber with spigot connections used to supply cell inflation fluid.

With reference to FIG. 12, each plenum chamber 18 comprises an aluminium upper plate 140 of 0.1875 inch thickness with holes drilled in it on the required cell 2 lattice, which, in this example, is a square lattice. A spigot 19 is disposed in each of the drilled holes and is bonded to the plate 140 by an epoxy resin.

The upper plate 140 has a bottom plate 142 of 0.0625 inch thickness bonded to it by the same resin. Slots 143 milled in the upper plate 140 define passages allowing full distribution of inflation air within the plenum chamber 18.

A quick-release air inlet coupling 145 is attached to the bottom plate 142. The coupling 145 is of the type marketed by the Quick Coupling Division of Parker Fluid Connectors, Minneapolis, MN55427, U.S.A. With reference to FIG. 5, in practice, the coupling 145 would comprise a demountable connection between branch line 94*a* and the associated plenum chamber 18, for example.

The internal volumes of each plenum chamber 18 and the inflated cells 2 attached thereto are in the order of about 1:100 in favour of the cells.

Each spigot 19 is formed with a small, (0.10 to 0.030 inch) diameter inflation air passageway 150 passing along its longitudinal axis. The small diameter passageway 150 contributes to the "stiffness" of a cell 2 should the cell be subjected to a transient increase in downwardly acting forces, caused for example, by the person being supported turning over on the upwardly-presented surfaces of the cells 2.

A peripheral groove 151 is formed in the exterior of the spigot 19. The groove 151 is used to secure a cell 2 firmly in place. In use, the bottom portion 9 of a cell 2 is pushed over the spigot 19 and a rubber "O" ring (not shown) forced over the bottom portion 9 where it is retained by the groove 151.

As mentioned above, the internal volume of the plenum chamber 18 is substantially less than the total internal volume of the inflated cells 2 connected thereto. This contributes, as do the small bore passageways 150 in the spigots 19, to the formation of a support surface which, while generally operating at low cell inflation pressure, will momentarily rise to a higher pressure to assist patient movement such as turning over.

The plenum chambers 18 illustrated are of aluminium. However, plastics material may be used as an alternative.

If plastics material is used to construct the plenum chambers 18, the spigots 19 thereof could be made integral with the equivalent of the upper plate 140. Alternatively, the spigots 19 (or their equivalent) could comprise non-integral components bonded to the upper plate.

A plenum chamber of plastics material could comprise a length of an extrusion, defining internal, longitudinally-extending ducts, (corresponding to the passageways formed by the slots 143 of FIG. 12), with end covers bonded in place. The end covers could be formed with recesses so as to allow air interflow between the ducts.

As used herein, "plastics material" includes rubber.

Figure 13:
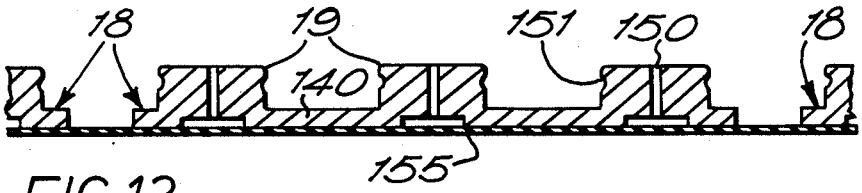
FIG. 13 is a side view illustrating an articulated plenum chamber assembly.

With reference to FIG. 13, plenum chambers 18 could be bonded to a rubber backing sheet 155, so that the chambers 18 are hinge-joined to each other to form an articulated assembly, which can be "rolled-up" when not in use.

The backing sheet 155 replaces the bottom plate 142 of FIG. 12.

Cell Heating and Cooling.

Figure 14:
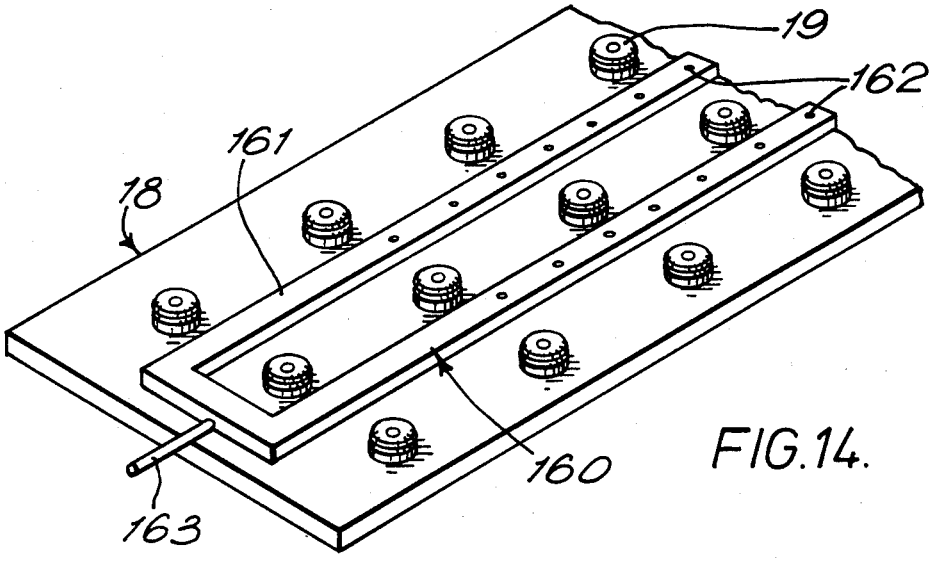
FIG. 14 is a view in perspective, which illustrates a cooling/heating air flow and air change system.

With reference to FIG. 14, to meet the requirements of physicians who desire to have a flow of air past a cell-supported patient, such a flow can be achieved by the use of distributors 160.

A distributor 160 comprises a duct 161 of "U"-like plan form defining rows of air outlet holes 162. The duct 161 is disposed on top of a plenum chamber 18. Air enters the duct 161 by way of a conduit 163.

Air leading the holes 162 escapes to atmosphere by way of spaces 6, (FIGS. 1 and 3), and vertices formed between the contiguous intermediate cell portions 5. There is no need to make special arrangements to ensure the presence of these vertices. When the system 1 is in operation, the formation of the vertices is unavoidable in the matrix formed when the cells are pressurised.

The air which serves as a heat transfer fluid, may be cooled or heated before distribution.

The air flow not only transfers heat, it also results in changing the air, which is considered beneficial.

As an alternative, the conduit 163 could be connected to the inlet of the blower 25 whereby air is drawn downwardly through the vertices. This arrangement prevents any risk of cross-contamination between patients.

For hygienic purposes, a sheet of air permeable material, such as "GORETEX" or "BION" (both Trade Marks), may be disposed between a patient and the cells 2 beneath. Such materials allow flows of air through them and provide one-way moisture barriers.

Hospital Beds.

Figure 15:
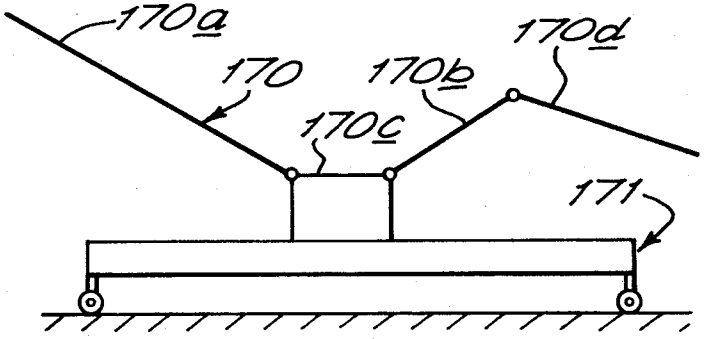
FIG. 15 illustrates a hospital bed.

With reference to FIG. 15, an articulated body support surface is preferred for hospital use, represented by a four-part surface 170. Three parts (170*a*, 170*b* and 170*d*) of the surface 170 are movable; the fourth part 170*c* is not. The surface 170 is mounted on a standard hospital bed 171. Part 170*a* is at the head of the bed 171. Part 170*d* is at the foot of the bed.

Figure 16:
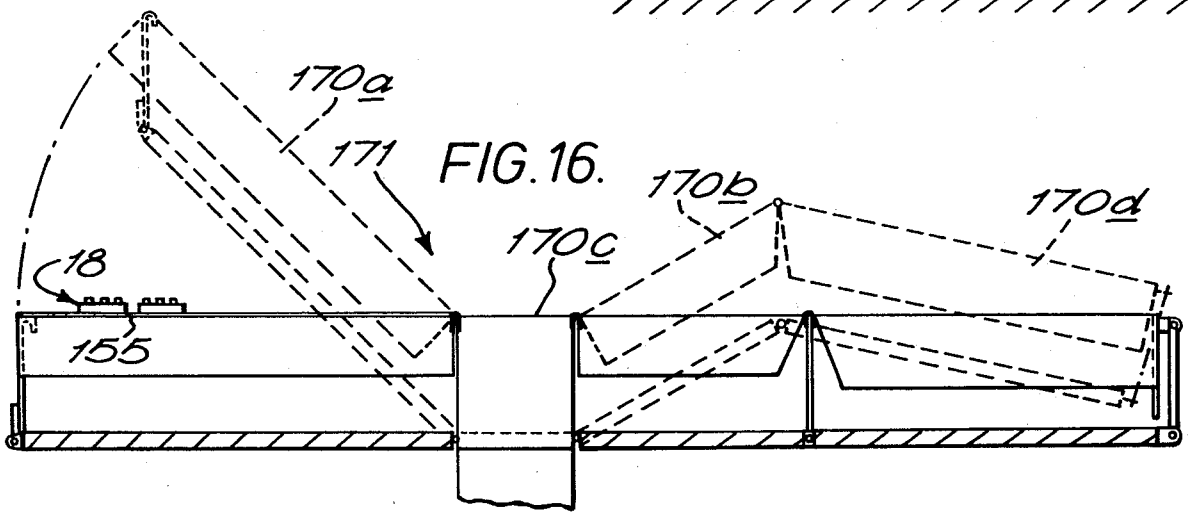
FIG. 16 is a side view which illustrates how the hospital bed may employ the fluid support system.

FIG. 16 illustrates how articulation can be obtained. In the figure, several plenum chambers 18 are mounted on a flexible backing sheet 155. (See FIG. 13). The arrangement not only allows articulation. It also allows easy removal and replacement.

To contain the cells 2 in place, restraint walls (not shown) are provided at the sides and ends of the bed 171. Ten walls are provided; one at each end and four on each side. The side-disposed walls are connected to each other by hinges and have cutaway portions to prevent interference with each other when they are articulated.

The cell restraint structure may incorporate elastic sections.

The invention may also be employed to restrain injured patients from moving about on the support surface whereby further injury could result. To this end, and taking the arrangement of FIG. 1 as an example, two systems 1 are employed, namely a lower system and an upper system, with (say) the trunk of the patient sandwiched between the systems in a lightly clamped manner.

I claim:

1. A fluid support system comprising a plurality of inflatable cells, blower means for supplying pressurised inflation fluid to the cells, electrically-powered drive means for driving the blower means, connectable to a source of electrical power, and valve means operable automatically, in the event of failure of the supply of electrical power, to seal-off inflation fluid present in the cells.

2. A system as claimed in claim 1, wherein the electrically-controlled valve means comprise solenoid-operated valve means biased towards closed positions, and held open by electrical energisation.

3. A system as claimed in claim 1, further comprising three-position valve means operable to direct the flow of inflation fluid through three alternative paths.

4. A system as claimed in claim 3, wherein the three-position valve means comprise spool valve means.

5. A system as claimed in claim 3, wherein the first flow path comprises a connection between the blower means and the inflatable cells, the second flow path comprises a connection between the inflatable cells and the atmosphere, and the third flow path comprises a combination of the first and second flow paths.

6. A system as claimed in claim 1, wherein the cells each have an upper portion, a lower portion and an intermediate portion, the intermediate portion of the cells being contiguous when inflated, wherein the upper portion of a cell defines a plurality of part-circular convexities.

7. A system as claimed in claim 6, wherein the convexities are disposed in stages, one stage being superimposed on another.

8. A system as claimed in claim 6, wherein the upper portion of a cell defines a single convexity superimposed on at least one convexity of annular form.

9. A system as claimed in claim 1, wherein the cells form groups, each of which is connected to a plenum chamber, the internal volume of the plenum chamber being substantially less than the total internal volume of the group of cells connected thereto.

10. A system as claimed in claim 9, wherein the plenum chambers are movable relative to each other in an articulated manner.

11. A system as claimed in claim 1, wherein the cells each have an upper portion, a lower portion and an intermediate portion, the intermediate portions being contiguous when the cells are inflated, and means for changing fluid present between the cells.

12. A system as claimed in claim 1, further comprising main duct connections between the blower means and atmosphere and branch duct connections between the main duct connections and the inflatable cells.

13. A system as claimed in claim 1, wherein the cells form groups, each of which is connected to a plenum chamber so as to be inflated therefrom, inflation fluid connections being provided between the blower means and the plenum chambers, and between the plenum chambers and atmosphere.

* * * * *